United States Patent [19]

Perrott, Sr.

[11] 4,006,889

[45] Feb. 8, 1977

[54] ASPHALT SEALER MIXER

[76] Inventor: Richard A. Perrott, Sr., P.O. Box 51, Hillsville, Pa. 16132

[22] Filed: July 18, 1975

[21] Appl. No.: 597,034

[52] U.S. Cl. ..... 259/176; 259/32

[51] Int. Cl.[2] ..... B28C 7/16

[58] Field of Search ..... 259/176, 85, 177 R, 259/177 A, 175, 3, 16, 31–33; 188/19, 29, 9, 10

[56] References Cited

UNITED STATES PATENTS

| | | | |
|---|---|---|---|
| 57,625 | 8/1866 | Growe | 188/9 |
| 1,053,741 | 2/1913 | Noble | 259/176 |
| 1,725,682 | 8/1929 | St. John | 259/176 X |
| 1,828,343 | 10/1931 | Schmidt | 259/175 |
| 2,507,077 | 5/1950 | Williams | 259/177 R |
| 2,558,765 | 7/1951 | Lichtenberg | 259/177 R X |
| 2,639,785 | 5/1953 | Vickers | 188/29 |

FOREIGN PATENTS OR APPLICATIONS

| | | | |
|---|---|---|---|
| 1,212,509 | 11/1970 | United Kingdom | 259/177 R |

*Primary Examiner*—Richard E. Aegerter
*Assistant Examiner*—John W. Shepperd
*Attorney, Agent, or Firm*—Brown, Murray, Flick & Peckham

[57] ABSTRACT

A portable mixer for asphalt sealer has a frame with bearings at its opposite ends, in which the trunnions of a rotatable horizontal drum are mounted. Secured to one of the trunnions is a crank for rotating the drum, which is provided in its top with a filling opening that is normally sealed by a removable cover. The end wall of the drum at the end opposite the crank has an outlet opening that is located at the bottom of the drum when the filling opening is at the top, and a discharge valve connected with this outlet projects from the end of the drum beneath the overlying bearing that is spaced inwardly from the end of the frame in such a manner that the valve will not strike any part of the frame as the drum is rotated. The mixer also is provided with a braking system that locks the wheels supporting the frame.

5 Claims, 4 Drawing Figures

ASPHALT SEALER MIXER

Asphalt, with which driveways are often paved, actually is porous enough for rain water to penetrate it and freeze beneath the paving and damage the pavement. Also, asphalt paving has a tendency to crack, and water accumulating in the cracks can freeze and cause further damage. Therefore, it is common practice to periodically apply a coating of waterproof sealing material to the surface of the paving to prevent water from penetrating it and to fill any cracks that may have formed. The composition of the sealing material is such that it requires thorough mixing just before application to the asphalt paving. The sealer is usually sold in large buckets or cans and it requires considerable effort and time to mix it, which is a messy operation at best.

It is among the objects of this invention to provide apparatus for mixing asphalt sealer which is readily portable, which can be delivered to a job site, filled with asphalt sealer, and which is easy to use, with the user being charged according to the amount of sealer used as determined by before and after measurements of the amount of sealer in the mixer.

The preferred embodiment of the invention is illustrated in the accompanying drawings, in which FIG. 1 is a side view;

Figure 1:
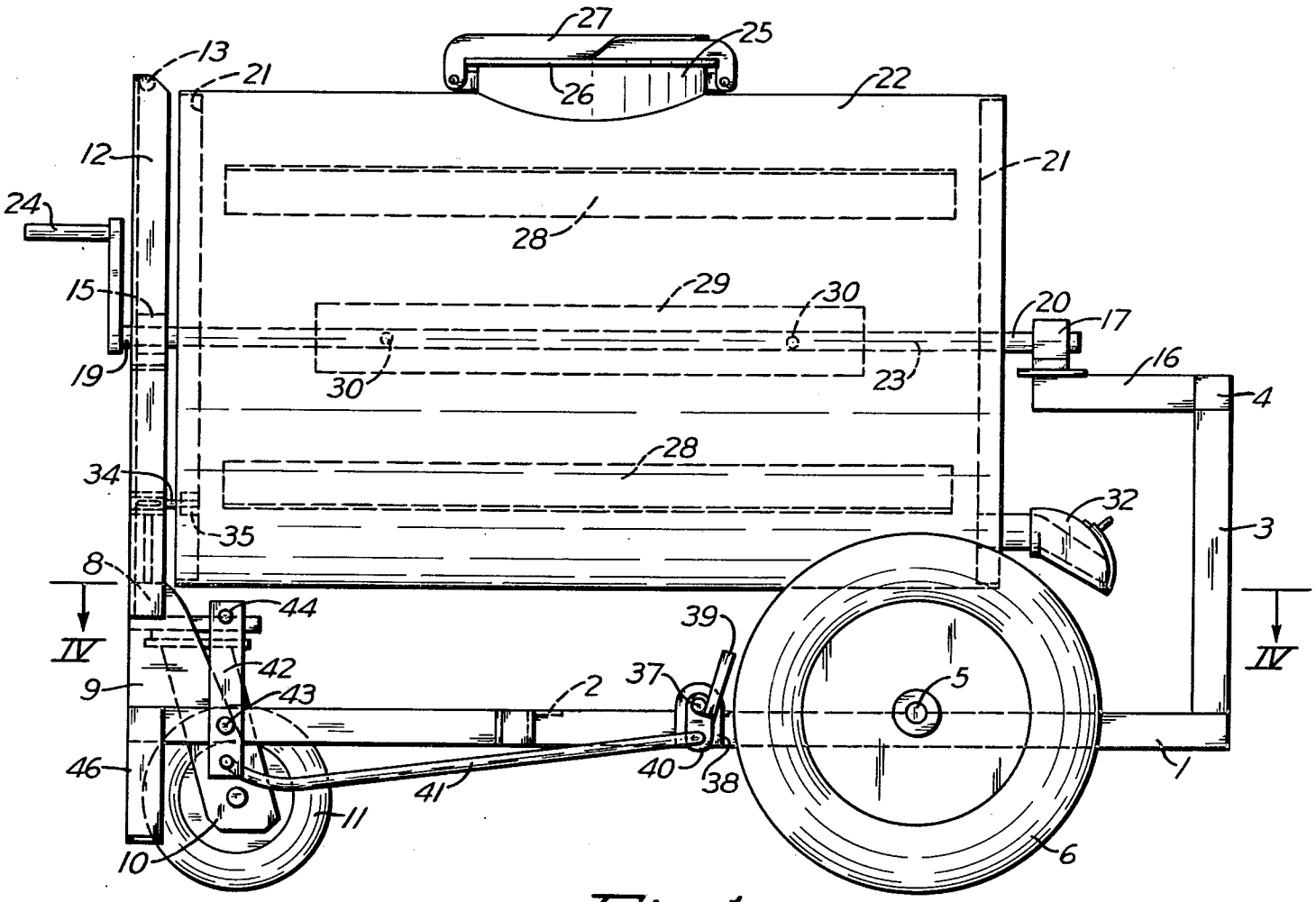

Referring to the drawings, a framework is constructed from a number of metal bars, such as angle bars, and includes a pair of substantially horizontal side frame bars 1 that are rigidly connected between their ends by a cross brace 2. Rigidly connected to one end of the side bars are the lower ends of a pair of parallel upright members 3, to the upper ends of which a cross bar 4 is secured. Between these upright members and the cross brace 2 of the frame an axle 5 is secured to the side bars. Rubber-tired wheels 6 are rotatably mounted on the projecting ends of the axle.

Figure 2:
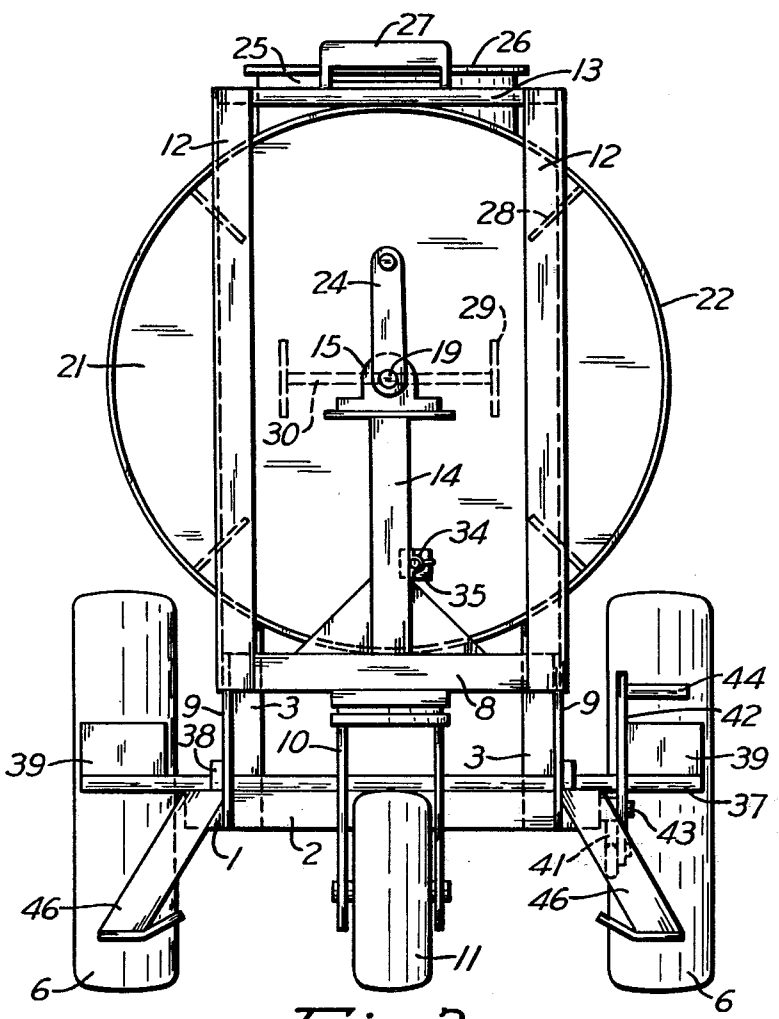
FIG. 2 is a front end view.

At the other or front end of the frame, as shown in FIG. 2, there is a cross bar 8 located a short distance above the underlying ends of the side bars. The opposite ends of this cross bar are secured to the upper ends of vertical plates 9 extending upwardly from the side bars. Pivotally connected to the center of this cross bar on a vertical axis is the upper end of a swivel yoke 10, in the lower end of which a rubber-tired wheel 11 is mounted. Extending upwardly from the opposite ends of cross bar 8 is a pair of upright members 12, the upper ends of which are connected by a tube 13 or rod that forms a handle for pushing or pulling the mixer.

Mounted on the center of cross bar 8 is a post 14 that supports at its upper end a bearing 15. The cross bar 4 at the rear end of the frame supports the outer end of a horizontal support bar 16 that extends inwardly toward the opposite end of the mixer as shown in FIG. 1. Mounted on the inner end of this support bar is a bearing 17 that is in alignment with the other bearing 15.

Rotatably mounted in the two bearings are the trunnions 19 and 20 of a rotatable mixing drum. These trunnions project from the centers of the circular end walls 21 of the drum. These end walls are connected by a cylindrical side wall 22. Preferably, the trunnions are formed by the projecting ends of a shaft 23 extending through the drum from end to end. Secured to trunnion

19, which is beneath handle 13, is a crank 24 by which the mixing drum can be rotated. Preferably, upright members 12 are long enough to locate handle 13 at the top of the drum.

The cylindrical side wall of the drum is provided with a large circular filling opening that is at the top of the drum while it is being filled and that is encircled by an upwardly extending flange 25. The opening can be closed and sealed by a cover 26 that is hinged to the flange at one side of the opening and clamped down by a member 27 hinged to the same flange at the opposite side of the opening. The cover is of such a type that it can be locked in closed position by a padlock. Inside the drum there are radial vanes 28 welded at their outer edges to the side wall of the drum and extending lengthwise of it. Also, it is highly desirable to attach a pair of parallel vanes 29 to the central shaft. This can be done by welding them to the outer ends of radial pins 30 projecting from the shaft. Vanes 29 will cut through the asphalt sealer as the drum is rotated, thereby helping to mix it.

Figure 3:
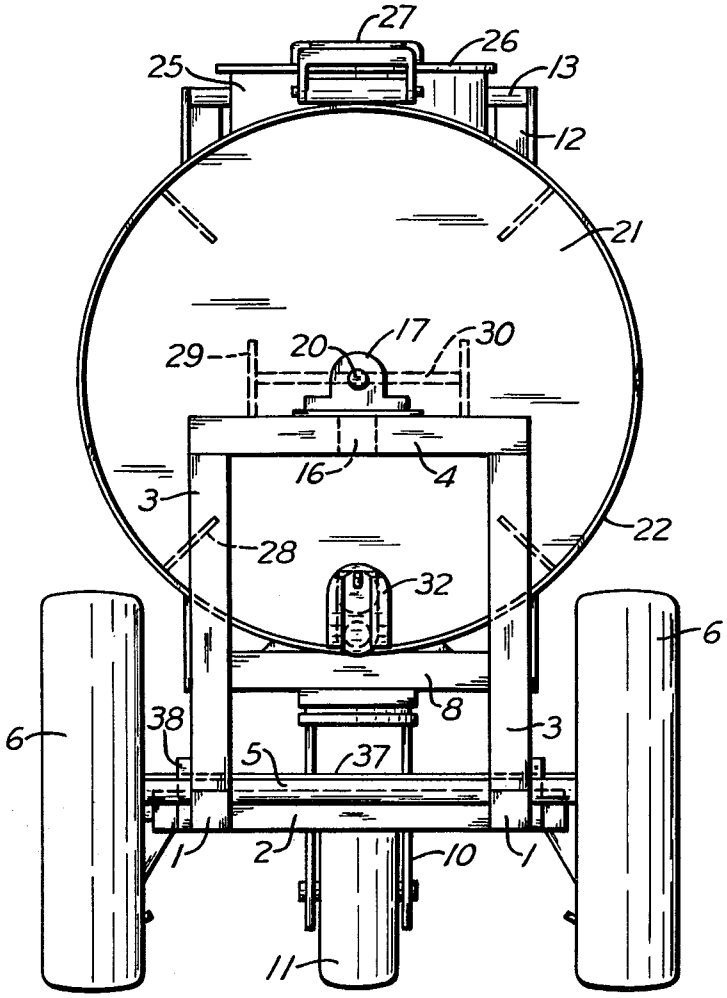
FIG. 3 is a rear end view.
Figure 4:
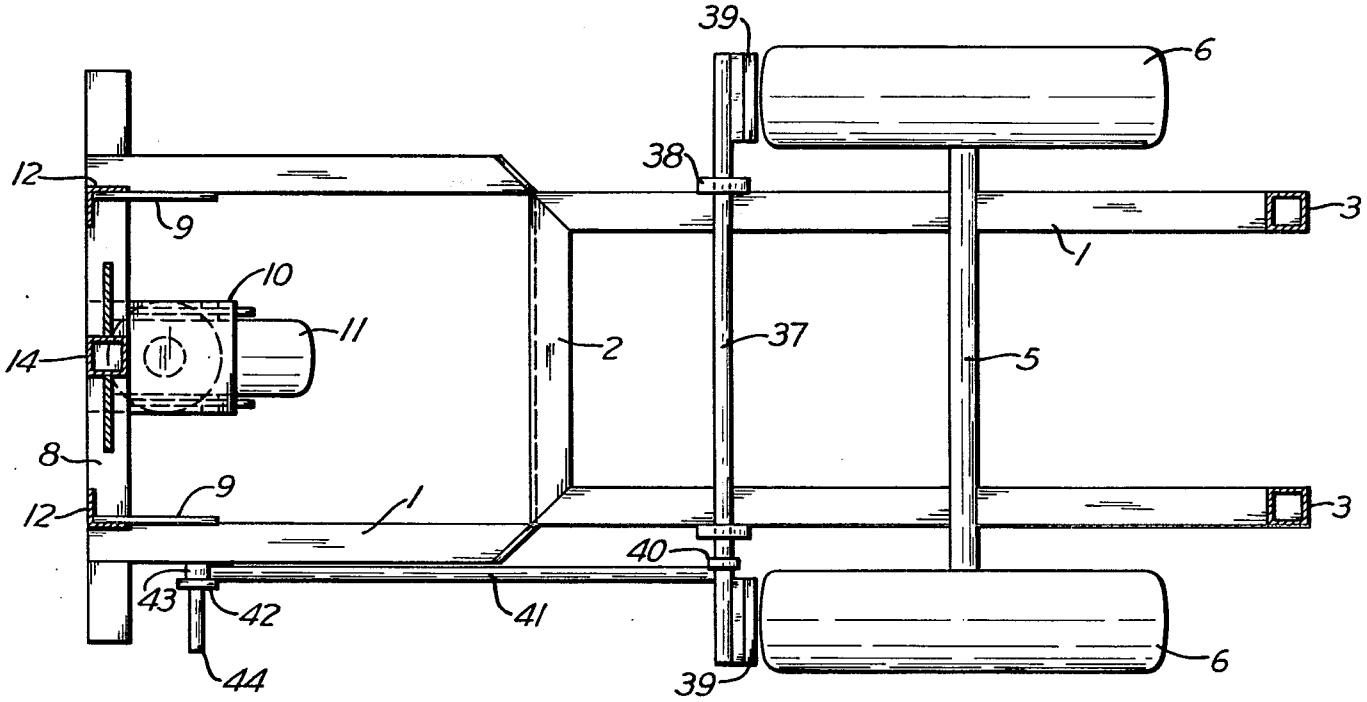
FIG. 4 is a horizontal section taken on the line IV-IV of FIG. 1.

The rear end of the drum, opposite to the crank, is provided with an outlet opening. The location of this opening is such that when the filling opening is at the top of the mixer, the outlet is at the bottom. Connected with the outlet is a discharge valve 32 of any suitable construction, but preferably one in which the outer end of the valve is closed by a sliding gate so that when the valve is opened there is nothing inside of the valve passage. The length of support bar 16 for bearing 17 is greater than the distance that the valve projects from the end of the drum. This spacing of the mixing drum from upright members 3 and cross bar 4 prevents those frame members from interfering with rotation of the drum by moving them away from the circular path that the valve travels in when the drum is turned. Also, by elevating cross bar 4 to approximately the level of the bearings, the space between the underlying ends of the side frame bars is left unobstructed as shown in FIGS. 3 and 4. An advantage of this is that a pail or like receptacle can readily be inserted between the ends of the side bars and moved back beneath the valve for filling with the asphalt sealer in the drum. Or, the pail can be set on the paving and then the mixer pushed forward until the valve is directly over the pail. After the pail is filled, the mixer can be pulled back away from it so that the pail can easily be picked up.

After the drum has been rotated by its crank to mix the sealer that is in it, the drum can be prevented from turning out of the position in which the valve is at the bottom. This can be done by mounting a sliding bolt 34 on the side of post 14 in a position in which its inner end can be moved into a hole in a block 35 welded to the adjacent end wall of the drum, as shown in FIGS. 1 and 2.

Since this mixer may often be used on a sloping driveway, it is desirable to provide it with brakes to hold it in place. Accordingly, a horizontal shaft 37 extends across the frame close behind wheels 6 and is rotatably mounted in brackets 38 extending upwardly from side frame bars 1. The opposite ends of the shaft are welded to the lower edges of a pair of metal plates 39 that serve as brake shoes when pressed against the tires. Also, welded to one end of the shaft and extending downwardly from it is a bracket 40 provided with a hole through it, in which one end of a brake rod 41 is pivotally mounted, the end of the rod being bent at right angles to its body through the hole. The opposite end of the rod also is bent and extends through a hole in the lower end of a brake lever 42. This lever normally extends upwardly. It is pivotally mounted near its lower end on a stub shaft 43 projecting from the side of the adjoining side frame bar. Projecting in the same direction from the upper end of the lever is a pin 44 that serves as a handle to permit the lever to be swung down, usually by pressing on the pin with the foot. The portion of the rod near the lever is curved downwardly so that when the upper end of the lever is swung forward and down to apply the brakes, the opposite end of the lever can be swung up behind the stub shaft into an over-center position, which will hold the brakes tightly against the adjoining tires until the pin 44 is raised to reverse the lever and thereby release the brakes.

The front end of the mixer may be provided with downwardly diverging outriggers 46 as shown in FIG. 2, that normally are spaced from the ground. They come into play only in case for some reason the mixer starts to tilt over sideways. The outriggers will limit the degree of tilt.

The asphalt sealer mixer disclosed herein can be used either by a driveway sealing contractor or by the home owner himself, since the mixer is easy and convenient to use and can readily be moved around. The asphalt sealer is not exposed during mixing, so it is a clean operation. If desired, the valve can be opened and the mixer moved around on the driveway while the sealer slowly runs out of the valve directly onto the paving.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. An asphalt sealer mixer comprising a pair of substantially horizontal side frame bars having front and rear ends, an axle secured to said bars near their front ends, wheels mounted on said axle, a pair of upright members rigidly connected at their lower ends to the front ends of the side frame bars, a cross bar secured to the upper ends of the upright members, a support bar connected at one end to the center of the cross bar and extending therefrom toward the opposite end of the mixer, a first bearing mounted on the free end of the support bar, a cross member supported by the side frame bars above their rear ends, a single rear swivel wheel between the rear ends of the side frame bars, means pivotally connecting the swivel wheel with the central portion of said cross member, a post mounted on the central portion of said cross member, a second bearing mounted on the upper end of said post in alignment with said first bearing, a mixing drum having spaced front and rear end walls connected by an encircling side wall, trunnions projecting from the centers of said end walls and rotatably mounted in said bearings, mixing vanes secured to the inside of the drum, the drum being provided in said side wall with a filling opening, a removable cover normally sealing said opening, the front end wall of the drum having a discharge opening located at the bottom of the drum when said filling opening is at the top, a discharge valve connected with said outlet opening and projecting forward from the end of the drum, the space between the front ends of said side frame bars being unobstructed to permit a pail to be inserted between them and moved back beneath said valve, and a crank secured to the trunnion in said second bearing for rotating the drum, said support bar being long enough for said valve to be carried around it by the rotating drum.

2. An asphalt sealer mixer according to claim 1, including a pair of tilt-limiting members secured at one end to the rear ends of said side frame bars and sloping laterally outward and down to points close to but normally spaced from the ground.

3. An asphalt sealer mixer according to claim 1, including a sleeve secured to said post, a pin slidably mounted in the sleeve and movable toward and away from the rear end wall of the drum, and a socket member mounted on said rear end wall for receiving the adjacent end of the pin for locking the drum with said discharge opening at the bottom of the drum.

4. An asphalt sealer mixer according to claim 1, including a shaft extending across the side frame bars behind said front wheels, means rotatably connecting the shaft to the side bars, brake shoes mounted on the ends of the shaft for engaging the front wheels, a lever, means pivoting the lever to one of the side bars on a horizontal axis behind one of said brake shoes, the lever having a free upper end, a brake rod having one end pivotally mounted in the lower end of the lever, and means extending downwardly from said shaft for pivotally receiving the other end of said rod, the portion of the rod near said lever curving downwardly to permit the rear end of the rod to be swung up behind said lever-pivoting means when said free end of the lever is swung forward and down, whereby to press the brake shoes against the front wheels and hold them there.

5. An asphalt sealer mixer according to claim 1, including a pair of upright members rigidly mounted at their lower ends on said cross member and extending upwardly beside said post to substantially the top of the drum, and a cross member connected to the upper ends of said last-mentioned upright members and forming a handle for pushing and pulling the mixer.

* * * * *